US012369731B2

(12) United States Patent
Secondino et al.

(10) Patent No.: US 12,369,731 B2
(45) Date of Patent: Jul. 29, 2025

(54) SLATWALL SYSTEMS AND RELATED METHODS

(71) Applicant: ENVE Profiles Inc., Mississauga (CA)

(72) Inventors: James Jonathan Secondino, Milton (CA); Paolo Marchesani, Woodbridge (CA)

(73) Assignee: ENVE Profiles Inc., Mississauga (CA)

( * ) Notice: Subject to any disclaimer, the term of this patent is extended or adjusted under 35 U.S.C. 154(b) by 0 days.

(21) Appl. No.: 18/420,156

(22) Filed: Jan. 23, 2024

(65) Prior Publication Data

US 2024/0245232 A1 Jul. 25, 2024

Related U.S. Application Data

(60) Provisional application No. 63/440,516, filed on Jan. 23, 2023.

(30) Foreign Application Priority Data

Jul. 26, 2023 (CA) ..... 3207664

(51) Int. Cl.
*A47F 5/08* (2006.01)

(52) U.S. Cl.
CPC ..... *A47F 5/0846* (2013.01)

(58) Field of Classification Search
CPC .... A47F 5/0846; A47F 5/0815; A47F 5/0853; A47F 5/0838; A47B 2096/207; A47B 2230/11; A47B 2096/209; A47B 2096/208
USPC ..... 211/87.01, 94.01
See application file for complete search history.

(56) References Cited

U.S. PATENT DOCUMENTS 3,532,212 A * 10/1970 Toth ..... A47B 95/04 206/343
3,906,696 A * 9/1975 Poter ..... E04D 3/358 52/592.4
4,531,331 A 7/1985 Itagaki
4,585,131 A * 4/1986 Crossman ..... A47B 96/1475 D25/123
4,591,058 A * 5/1986 Amstutz ..... A47F 5/0846 52/36.5

(Continued)

FOREIGN PATENT DOCUMENTS

CA 3133891 A1 4/2022
CA 3109041 A1 8/2022

(Continued)

OTHER PUBLICATIONS

International Search Report & Written Opinion mailed Apr. 24, 2024 in PCT/CA2024/050075.

*Primary Examiner* — Jennifer E. Novosad

(57) ABSTRACT

A slatwall system for installation on a wall structure includes a plurality of identical panels interconnectable with each other one above another in a coplanar slatwall arrangement. Each panel has an accessory slot for mounting an organization accessory to the panel, and a fastener slot for receiving fasteners to secure the panel to the wall structure. A plurality of identical covers are provided. Each cover is detachably mountable to a respective fastener slot for concealing the fastener slot and the fasteners. Each cover is detachable from the fastener slot for accessing the fasteners to permit removal of a respective panel from the wall structure.

18 Claims, 5 Drawing Sheets

(56) References Cited

U.S. PATENT DOCUMENTS 5,121,578 A * 6/1992 Holz ..... E04B 9/26 52/510
5,138,803 A * 8/1992 Grossen ..... A47F 5/0846 211/208
5,170,605 A * 12/1992 Huddle ..... F25D 17/005 52/630
5,253,835 A * 10/1993 Herron, III ..... A47B 96/1408 211/187
D345,499 S * 3/1994 Padilla ..... D8/381
5,477,645 A * 12/1995 Bauer ..... A47F 5/0846 52/146
6,116,435 A * 9/2000 Young ..... F16B 13/124 411/510
6,119,878 A * 9/2000 Zen ..... A47F 5/0846 248/222.51
6,363,645 B1 * 4/2002 Hunter ..... A47F 5/0846 211/87.01
6,385,939 B1 * 5/2002 Stout ..... G09F 15/0025 52/287.1
6,644,609 B1 * 11/2003 Scott ..... A47B 96/1458 248/909
7,108,141 B2 * 9/2006 Gonzalez-Rivera ... B65D 85/30 211/94.01
7,306,107 B2 * 12/2007 Secondino ..... A47F 5/0846 211/94.01
D568,060 S * 5/2008 Munson ..... A47F 5/0846 D25/138
7,571,571 B1 * 8/2009 Mershon ..... E04F 13/12 52/36.5
7,806,279 B2 * 10/2010 Kubota ..... A47F 5/0846 211/94.01
8,066,130 B2 * 11/2011 Shaha ..... A47B 96/067 211/106.01
8,220,648 B2 * 7/2012 Barkdoll ..... A47F 5/0846 211/94.01
8,365,928 B1 * 2/2013 Lauro ..... A47B 57/34 211/183
8,434,835 B2 * 5/2013 Hardy ..... A47B 96/067 211/94.01
8,511,627 B2 * 8/2013 Lutze ..... H02B 1/32 248/225.11
8,763,312 B2 * 7/2014 Carter ..... E04F 13/0894 52/36.5
8,783,476 B2 * 7/2014 Woodley ..... A47B 95/043 211/183
D804,227 S * 12/2017 Jung ..... D6/703
10,610,016 B2 * 4/2020 Nilsson ..... A47B 57/16
11,759,010 B2 * 9/2023 Drew ..... A47B 96/1458 211/187
12,029,317 B2 * 7/2024 Li ..... A47B 96/20
2001/0030273 A1 * 10/2001 Veazey ..... G09F 7/18 248/475.1
2006/0207201 A1 * 9/2006 Klimek ..... A47F 5/0846 52/239
2007/0089819 A1 * 4/2007 Zenkich ..... A47F 5/0043 150/158
2022/0120091 A1 * 4/2022 Letham ..... E04F 13/12
2022/0248873 A1 8/2022 Prizzi et al.
2022/0248874 A1 * 8/2022 Prizzi ..... A47F 5/0853
2024/0245232 A1 * 7/2024 Secondino ..... A47F 5/0853

FOREIGN PATENT DOCUMENTS

CA 3148147 A1 8/2022
WO WO-2024156055 A1 * 8/2024 ..... A47F 5/0846

* cited by examiner

SLATWALL SYSTEMS AND RELATED METHODS

CROSS-REFERENCE TO RELATED APPLICATIONS

This application claims the benefit of U.S. Provisional Application No. 63/440,516 filed Jan. 23, 2023 and Canadian Patent Application No. 3,207,664 filed Jul. 26, 2023, each of which is hereby incorporated herein by reference in its entirety.

FIELD

The present specification relates generally to slatwall systems for installation on wall structures.

BACKGROUND

U.S. Pat. No. 7,306,107 (Secondino) discloses a panel for use in a plurality for a slat wall comprising a panel body with inner and outer surfaces, and upper and lower edges. A vertical link at the rear of the upper edge has an inner surface coplanar with the body inner surface; a fastener receiving member connected across the vertical link has an upwardly extending tongue and downwardly extending leg, having vertically coplanar outer surfaces and defining a first groove to receive fasteners to secure the panels to the wall. A cover extending from the body outer surface has a free end with an inward projection, the cover and a rear protrusion of the body lower edge together defining a second groove. When installed, the second grooves receive tongues of adjacent panels; the covers extend over the first grooves of adjacent panels; and the inward projections engage with outer surfaces of legs of adjacent panels.

U.S. Pat. App. Pub. No. 2022/0120091 (Letham) discloses a slatwall assembly and related slatwall for covering an existing wall. The slatwall assembly includes a surface profile and a reinforcing profile, at least one of the two being attachable to the existing wall. The surface profile includes a front vertical panel that is positionable with respect to the existing wall to define a gap therebetween and provide coverage thereto. The reinforcing profile is operatively coupled to the surface profile. The material of the reinforcing profile can be stronger than the material of the surface profile for reinforcement thereof when coupled together. The reinforcing profile can be operatively coupled to the surface profile so as to be held together for attachment onto the existing wall. The surface profile can be configured to cover at least a portion of the reinforcing profile, so as not to expose the reinforcing profile when an entire slatwall is assembled from the plurality of slatwall assemblies.

U.S. Pat. App. Pub. No. 2022/0248874 (Prizzi et al.) discloses a panel comprising an interacting portion, defining a covering portion and a first panel-defined interacting counterpart. The interacting portion is biased to a pre-deformation configuration, wherein the interacting portion is tapering rearwardly. At least a portion of the interacting portion is deformable from the pre-deformation configuration for effectuating transitioning of the interacting portion to an interference-effective deformed configuration, wherein the transitioning includes a forwardly displacement of the first panel-defined interacting counterpart. The first panel-defined interacting counterpart and a second panel-defined interacting counterpart, of a second panel, are configurable for disposition in a relative movement interference relationship, wherein interference, to relative movement, between the panels, is established. While the first panel-defined interacting counterpart and the second panel-defined interacting counterpart are disposed in the relative movement interference relationship, and the second panel is connected to a wall with a fastener, the covering portion of the panel is covering the fastener.

SUMMARY

The following summary is intended to introduce the reader to various aspects of the applicant's teachings, but not to define any invention.

According to some aspects, a slatwall system for installation on a wall structure includes: (a) at least one panel having an inner face for positioning against the wall structure and an opposite outer face spaced apart from the inner face by a panel thickness, the inner and outer faces extending lengthwise along a panel axis between opposite ends of the panel and vertically between upper and lower edges of the panel. Each panel includes: (i) an upper joint profile extending along the upper edge, (ii) a lower joint profile extending along the lower edge, the lower joint profile of each panel interconnectable with the upper joint profile of another identical panel for interconnecting vertically adjacent panels on the wall structure in a coplanar slatwall arrangement, (iii) an accessory slot in the outer face and extending along the panel axis, the accessory slot configured for mounting an organization accessory to the panel, and (iv) a fastener slot in the outer face and extending along the panel axis vertically intermediate the accessory slot and the upper edge of the panel, the fastener slot for receiving fasteners to secure the panel to the wall structure. The slatwall system further includes (b) at least one cover extending along the panel axis and detachably mountable to the fastener slot for concealing the fastener slot and fasteners, and the cover detachable from the fastener slot for accessing the fasteners to permit removal of the panel from the wall structure.

In some examples, the cover is mountable to the fastener slot through a snap-fit connection.

In some examples, the cover has a cover body positionable over the outer face of the panel to cover the fastener slot, and one or more snap-fit connectors projecting inwardly from the cover body and insertable into the fastener slot for snap-fit engagement between the cover and the panel.

In some examples, the fastener slot has a T-slot profile comprising a fastener cavity open to the outer face of the panel through a fastener opening, the fastener opening between an upper lip of the panel extending downwardly along and bounding an upper portion of the cavity and a lower lip of the panel extending upwardly along and bounding a lower portion of the cavity.

In some examples, the one or more snap-fit connectors include a pair of clips spaced vertically apart from each other for insertion into the cavity through the opening for snap-fit engagement with respective upper and lower lips.

In some examples, when mounted, the cover projects vertically from the panel for concealing an interface between interconnected panels.

In some examples, when mounted, the cover extends between a lower end positioned vertically intermediate the fastener slot and the accessory slot, and an upper end at an elevation above the upper edge of the panel for concealing an interface between the panel to which the cover is mounted and another panel above and interconnected with the panel in the slatwall arrangement.

In some examples, the cover has a generally planar cover body extending between the upper and lower ends and covering the fastener slot and the interface.

In some examples, the lower end of the cover comprises a lower flange portion extending inwardly from the cover body toward the panel for bearing against the outer face of the panel to which the clip is mounted, and the upper end of the cover comprises an upper flange portion extending inwardly from the cover body for bearing against the outer face of the other panel.

In some examples, each panel is attachable to the wall vertically between a pair of other panels in the slatwall arrangement, and wherein the upper and lower joint profiles are configured to accommodate removal of each panel from between the pair of other panels without requiring removal of either of the other panels from the wall structure.

In some examples, the upper joint profile comprises one of a groove and a tongue and the lower joint profile comprises the other one of the groove and the tongue, and the tongue of each panel is receivable in the groove of another panel for interconnection therebetween in the slatwall arrangement.

In some examples, the upper joint profile comprises the groove and the lower joint profile comprises the tongue.

In some examples, the groove is open to the inner face and upper edge of the panel and the tongue is in horizontal alignment with the groove.

In some examples, the tongue has an inner surface directed toward the wall structure and an outer surface opposite the inner surface and directed away from the wall structure, the outer surface recessed inwardly from the outer face of the panel to define a recess in the lower edge of the panel, the recess open downwardly and outwardly to the outer face of the panel for receiving the upper edge of a lower one of the other panels.

In some examples, the accessory slot has an undercut L-shaped profile comprising an accessory cavity open to the outer face of the panel through an accessory opening, the opening between a floor surface of the cavity and an upper lip of the panel extending downwardly along an upper portion of the accessory cavity.

In some examples, each of the panel and the cover is of integral, unitary, one-piece construction.

In some examples, each of the panel and the cover is formed of a polymeric material.

In some examples, the panel and the cover are different colors.

In some examples, the fastener slot is open to the outer face of the panel through a fastener opening for receiving the fasteners, and the fastener slot is bounded inwardly by a vertical endwall opposite the opening and through which the fasteners are drivable to secure the panel to the wall structure.

In some examples, the panel has at least one support wall in vertical alignment with the fastener opening and extending horizontally inwardly from the vertical endwall toward the wall structure for inhibiting deflection of the endwall toward the wall structure when driving fasteners therethrough.

In some examples, each panel comprises a pair of the internal support walls spaced vertically apart from each other by a fastener channel through which the fasteners pass in close fit when driven through the panel.

In some examples, the endwall has an endwall surface directed away from the wall structure toward the fastener opening, and a notch formed in the endwall surface in vertical alignment with the fastener opening and the fastener channel for guiding positioning of the fasteners.

In some examples, each panel has a top wall defining the upper edge of the panel and extending horizontally between the inner and outer faces of the panel, and wherein the pair of the internal support walls are spaced vertically below the top wall.

According to some aspects, a slatwall system for installation on a wall structure includes: (a) a plurality of identical panels interconnectable with each other one above another in a coplanar slatwall arrangement, each panel having an accessory slot extending along a length of the panel for mounting an organization accessory to the panel, and a fastener slot spaced vertically apart from the accessory slot and extending along the length of the panel for receiving fasteners to secure the panel to the wall structure; and (b) a plurality of identical covers, each cover extending along the length of the panel and detachably mountable to a respective fastener slot for concealing the fastener slot and fasteners, and each cover detachable from the fastener slot for accessing the fasteners to permit removal of a respective panel from the wall structure.

In some examples, each cover is mountable to a respective fastener slot through snap-fit engagement with the panel.

In some examples, each cover has one or more snap-fit connectors insertable into the fastener slot for snap-fit engagement between the cover and the panel.

In some examples, when mounted, the cover projects vertically from the panel for concealing an interface between interconnected panels.

In some examples, the fastener slot is adjacent an upper edge of the panel, and when mounted, the cover projects upwardly from the upper edge of the panel for concealing an interface between interconnected panels.

In some examples, the accessory slot is below and adjacent the fastener slot.

In some examples, each panel has an upper edge, a lower edge vertically opposite the upper edge, one of a tongue and a groove extending along the upper edge, and the other one of the tongue and the groove extending along the lower edge, and wherein the tongue of each panel is receivable in the groove of another panel for interconnection therebetween in the slatwall arrangement.

In some examples, the upper edge of each panel comprises the groove and the lower edge of each panel comprises the tongue.

In some examples, the tongue is recessed inwardly from an outer face of the panel directed away from the wall structure to define a recess in the lower edge of the panel, the recess open downwardly and to the outer face of the panel for receiving the upper edge of another panel when the panels are installed on the wall structure.

According to some aspects, a slatwall system for installation on a wall structure includes: (a) a plurality of panels interconnectable with each other one above another in a slatwall arrangement, each panel having an accessory interface for mounting an organization accessory to the panel, and at least one fastener locating feature formed in the panel for receiving one or more fasteners to secure the panel to the wall structure; and (b) a plurality of covers, each cover mountable to a respective panel over a respective locating feature for concealing the locating feature and the one or more fasteners.

In some examples, the at least one locating feature comprises a recess open to an outer face of the panel directed away from wall structure.

In some examples, the recess comprises a slot extending along a length of the panel for receiving a plurality of the fasteners.

In some examples, the at least one locating feature comprises a notch facing away from the wall structure for guiding positioning of the fasteners.

In some examples, the at least one locating feature comprises an opening in the panel.

In some examples, each cover is detachable from a respective panel for accessing the one or more fasteners to permit removal of the respective panel from the wall structure.

In some examples, each cover is mountable to the panel through a snap-fit connection.

In some examples, the locating feature is above the accessory interface adjacent an upper edge of the panel.

In some examples, when mounted to the panel, the cover projects vertically from the panel for concealing an interface between interconnected panels.

In some examples, each panel has a lower joint profile at the lower edge of the panel and an upper joint profile at an upper edge of the panel, the lower joint profile of each panel configured to mate with the upper joint profile of each panel for interconnecting the plurality of panels in the slatwall arrangement.

In some examples, the upper and lower joint profiles are configured to accommodate removal of each panel from between a pair of interconnected panels above and below the panel without requiring removal of the pair of interconnected panels from the wall structure.

According to some aspects, a method of configuring a slatwall system, comprising: (a) fastening a plurality of panels of the slatwall system to a wall structure in a slatwall arrangement by driving a plurality of fasteners through each panel and into the wall structure, the plurality of panels interconnected with each other one above another in the slatwall arrangement; and (b) mounting a respective cover of the slatwall system to each panel to conceal the plurality of fasteners.

In some examples, each panel has an accessory slot, and the method includes mounting one or more organization accessories to at least one accessory slot.

In some examples, when mounted, each cover projects vertically from a respective panel to conceal an interface between interconnected panels.

In some examples, each cover is detachably mounted to a respective panel.

In some examples, each cover is mounted through snap fit engagement with the panel.

In some examples, (a) includes, for each panel, driving the plurality of fasteners through the panel when the plurality of fasteners are positioned in a fastener slot of the panel.

In some examples, (b) includes mounting the cover to the fastener slot.

In some examples, (b) includes mounting the cover into snap fit engagement with the fastener slot.

In some examples, the plurality of panels includes a lower panel, an upper panel, and an intermediate panel vertically between and interconnected with the lower and upper panels, and the method further includes removing the cover from the intermediate panel, removing the plurality of fasteners fastening the intermediate panel to the wall structure, and removing the intermediate panel from between the upper and lower panels while the upper and lower panels remain fastened to the wall structure.

BRIEF DESCRIPTION OF THE DRAWINGS

The drawings included herewith are for illustrating various examples of systems, methods, and apparatuses of the present specification and are not intended to limit the scope of what is taught in any way. In the drawings.

DETAILED DESCRIPTION

Figure 1:
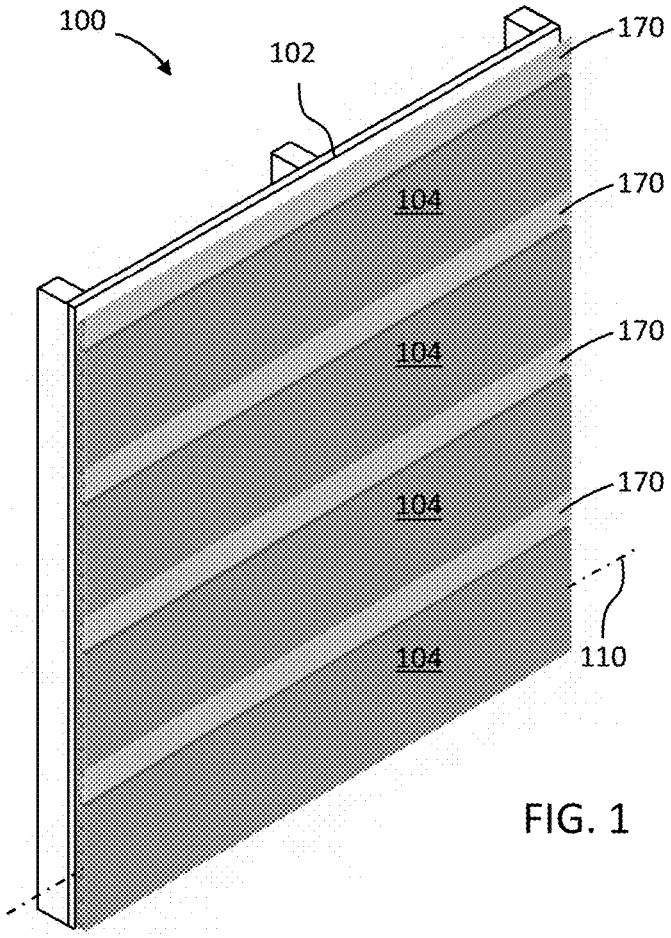
FIG. 1 is a perspective view of an example slatwall system.

Various apparatuses, systems, or processes will be described below to provide an example of an embodiment of each claimed invention. No embodiment described below limits any claimed invention and any claimed invention may cover systems, processes, or apparatuses that differ from those described below. The claimed inventions are not limited to systems, apparatuses, or processes having all of the features of any one system, apparatus, or process described below or to features common to multiple or all of the systems, apparatuses, or processes described below. It is possible that a system, apparatus, or process described below is not an embodiment of any claimed invention. Any invention disclosed in a system, apparatus, or process described herein that is not claimed in this document may be the subject matter of another protective instrument, for example, a continuing patent application, and the applicants, inventors, or owners do not intend to abandon, disclaim, or dedicate to the public any such invention by its disclosure in this document.

A slatwall is a wall covering having horizontal slots for mounting organization accessories (e.g. hooks, shelves, bins, displays, products, etc.) at various heights. Some slatwall systems include a plurality of identical slatwall panels installable one above another over an existing finished or unfinished wall structure (e.g. framing, drywall, partitions, etc.). In some designs, each slatwall panel can be secured to the wall structure using fasteners, which can be concealed by a subsequently installed panel for aesthetics and/or to inhibit detachment of the panels. In some designs, the manner in which the fasteners are concealed and/or the slatwall panels interlock can make it inconvenient to replace a single slatwall panel (e.g. if damaged). For example, replacement of a single panel may require partial or full removal of other panels above and/or below the panel being replaced to access the fasteners and/or to disengage the panel being replaced from other panels.

According to some aspects of the present disclosure, slatwall systems are disclosed that can help address some of the shortcomings of existing designs. In some examples, the slatwall systems of the present disclosure include a plurality of identical panels interconnectable with each other one above another in a coplanar slatwall arrangement. Each panel has an accessory slot extending along a length of the panel for mounting an organization accessory to the panel, and a fastener slot spaced vertically apart from the accessory slot and extending along the length of the panel for receiving fasteners to secure the panel to the wall structure. A plurality of identical covers are provided. Each cover extends along the length of the panel and is detachably mountable to a respective fastener slot for concealing the fastener slot and the fasteners. Each cover is detachable from the fastener slot for accessing the fasteners to permit removal of a respective panel from the wall structure, without necessarily requiring removal of adjacent wall panels in some examples.

Referring to FIG. 1, an example slatwall system 100 for installation on a wall structure 102 is shown. In the example illustrated, the slatwall system 100 includes a plurality of identical panels 104 interconnectable with each other one above another for installation against the wall structure 102 in a coplanar slatwall arrangement.

Figure 2:
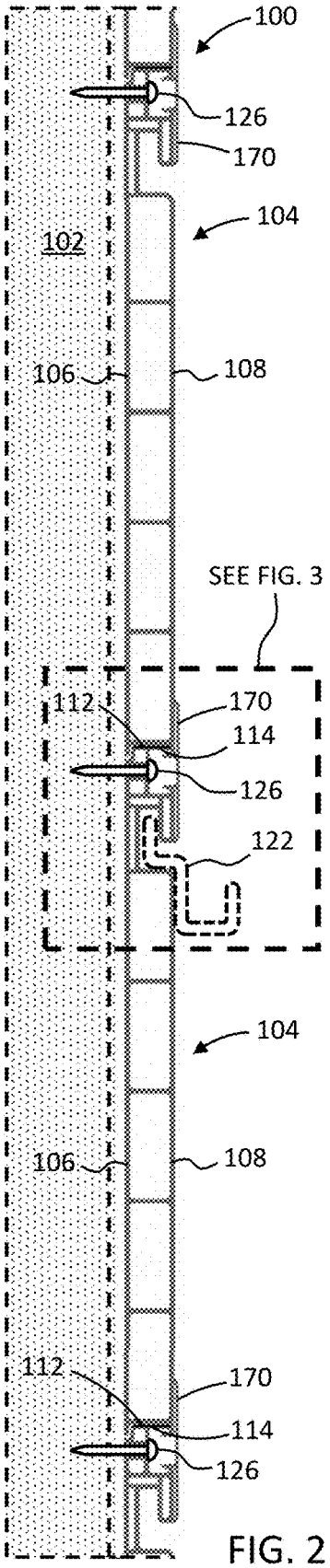
FIG. 2 is a side elevation view of a portion of the slatwall system of FIG. 1.

Referring to FIG. 2, in the example illustrated, each panel 104 has an inner face 106 for positioning against the wall structure 102, and an opposite outer face 108 spaced apart from the inner face 106 by a panel thickness and directed away from the wall structure 102. The inner and outer faces 106, 108 extend lengthwise along a panel axis 110 (FIG. 1) between opposite ends of the panel 104. In the example illustrated, the panel axis 110 is oriented horizontally along the wall structure 102 when the panels are installed on the wall structure 102 in the slatwall arrangement. The inner and outer faces 106, 108 extend vertically between upper and lower edges 112, 114 of the panel 104. The upper and lower edges 112, 114 extend along the panel axis 110 (FIG. 1) between the opposite ends of the panel 104. In the example illustrated, the inner face 106 is generally planar, and the outer face 108 is generally planar and parallel with the inner face 106.

Figure 4:
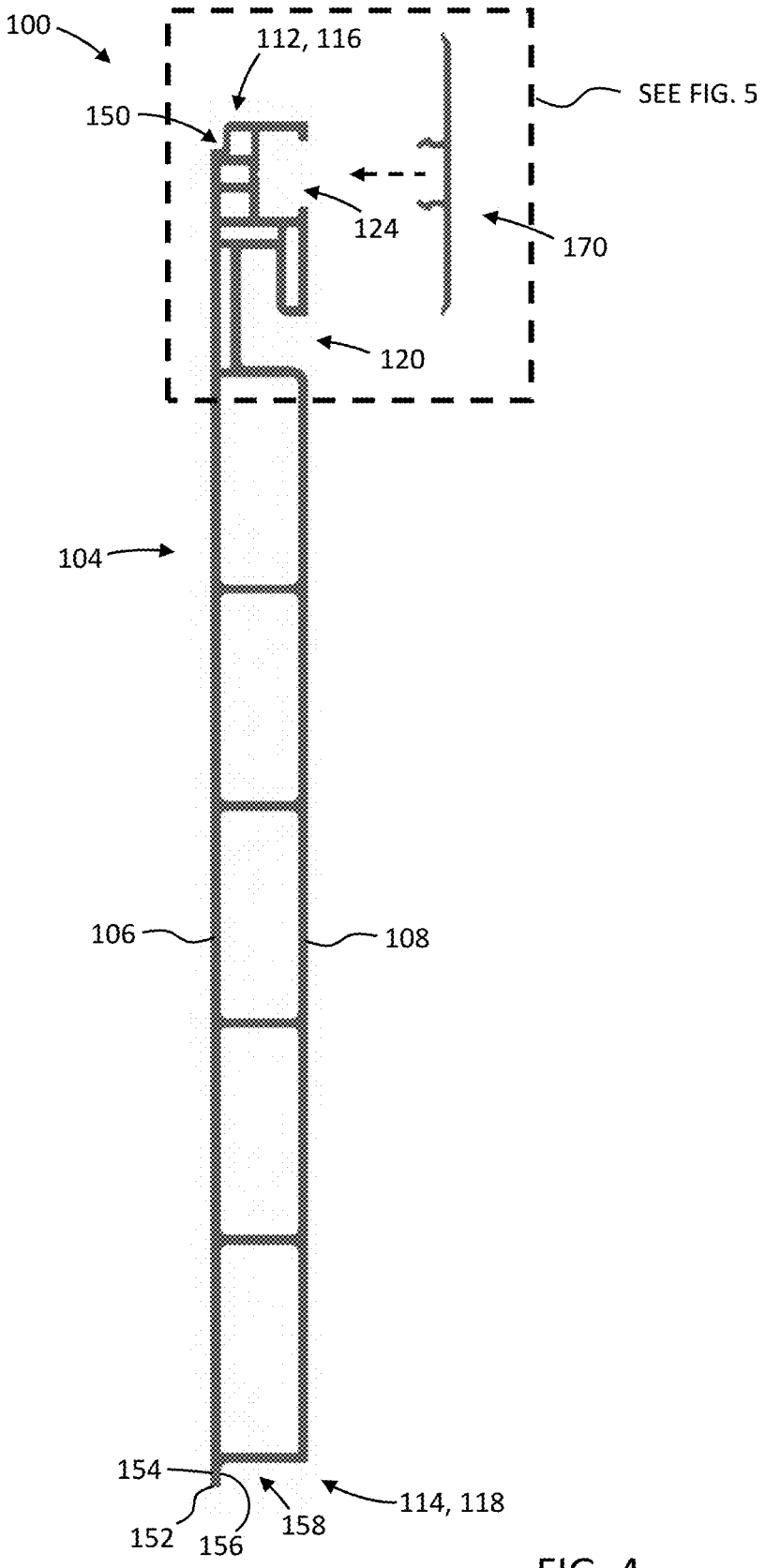
FIG. 4 is an exploded side elevation view of a panel and cover of the slatwall system of FIG. 1.

Referring to FIG. 4, in the example illustrated, each panel 104 has an upper joint profile 116 extending along the upper edge 112 and a lower joint profile 118 extending along the lower edge 114. The lower joint profile 118 of each panel 104 is interconnectable with the upper joint profile 116 of another panel 104 for interconnecting vertically adjacent panels 104 on the wall structure 102 in the coplanar slatwall arrangement, to help inhibit relative horizontal movement between the interconnected upper and lower edges 112, 114 of the panels 104 when on the wall structure 102.

Figure 3:
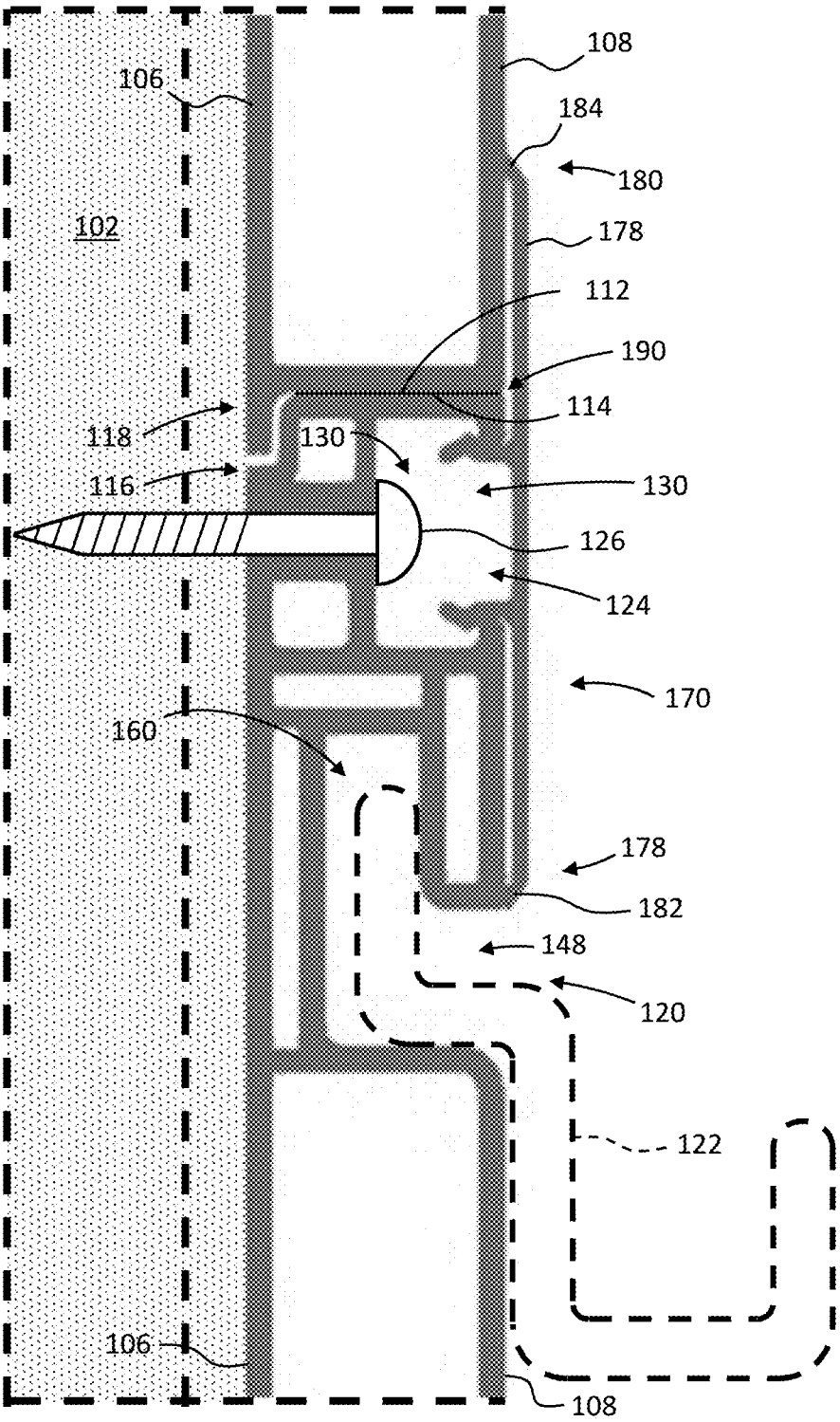
FIG. 3 is an enlarged view of a portion of the slatwall system of FIG. 2.

Referring to FIG. 3, in the example illustrated, each panel 104 has an accessory slot 120 in the outer face 108 and extending along the panel axis 110. The accessory slot 120 is configured for mounting an organization accessory 122 (e.g. hook, shelf, basket, etc.) to the panel 104.

In the example illustrated, each panel 104 further includes a fastener slot 124 in the outer face 108 and extending along the panel axis 110 vertically intermediate the accessory slot 120 and the upper edge 112 of the panel 104. The fastener slot 124 receives fasteners 126 to secure the panel 104 to the wall structure 102. In the example illustrated, the fastener slot 124 is adjacent the upper edge 112 of the panel 104, and the accessory slot 120 is spaced vertically below (and is generally adjacent) the fastener slot 124. In the example illustrated, each of the fastener slot 124 and the accessory slot 120 extends along an entire length of the panel 104.

Referring to FIG. 4, in the example illustrated, the slatwall system 100 further includes a plurality of identical fastener covers 170 extending along the panel axis 110. In the example illustrated, the fastener cover 170 extends along the entire length of the panel 104. Referring to FIG. 3, the fastener cover 170 is detachably mountable to the fastener slot 124 for concealing the fastener slot 124 and fasteners 126. The fastener cover 170 is detachable from the fastener slot 124 for providing access to the fasteners 126 to permit removal of the panel 104 from the wall structure 102.

Figure 5:
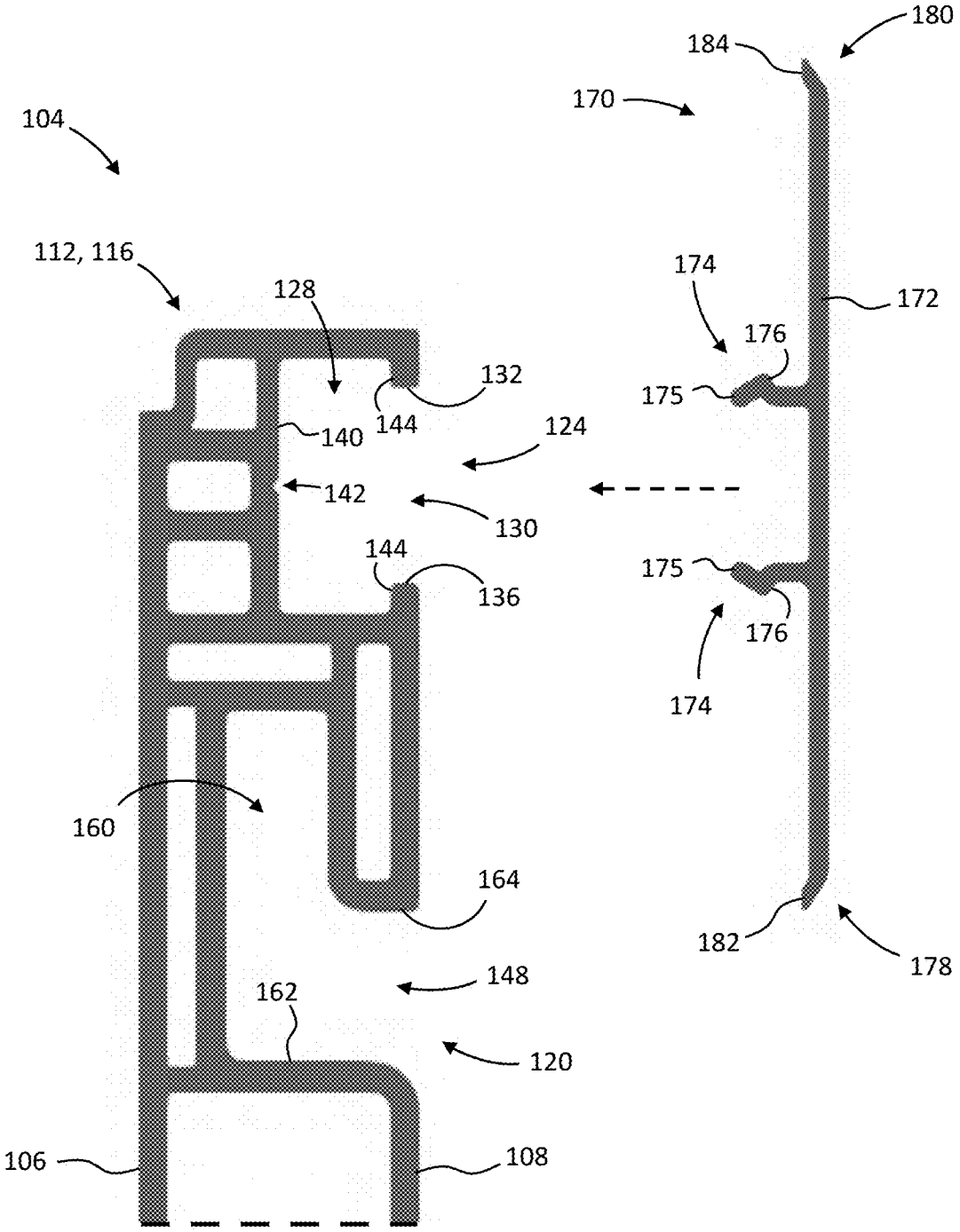
FIG. 5 is an enlarged view of a portion of the panel and cover of FIG. 4.

Referring to FIG. 5, in the example illustrated, the fastener slot 124 has a T-slot profile comprising a fastener cavity 128 open to the outer face 108 of the panel 104 through a restricted fastener opening 130. The fastener opening 130 extends vertically between an upper lip 132 of the panel 104 extending along and bounding an upper portion of the cavity 128 and a lower lip 136 of the panel 104 extending along and bounding a lower portion of the cavity 128. In the example illustrated, the fastener slot 124 has an endwall surface 140 opposite and facing the opening 130. A notch 142 is formed in the endwall surface 140 in alignment with the opening 130 and extending along the panel axis 110 to help guide positioning of the fasteners 126 in the fastener slot 124.

In the example illustrated, the cover 170 clips into snap-fit engagement with the fastener slot 124 for detachably mounting the cover 170 to the panel 104. In the example illustrated, the cover 170 has a generally planar cover body 172 positionable over the outer face 108 of the panel 104 to cover the fastener slot 124. One or more snap-fit connectors 174 project inwardly from the cover body 172 toward the panel 104 and are insertable into the fastener slot 124 for snap-fit engagement between the cover 170 and the panel 104.

In the example illustrated, the one or more snap-fit connectors 174 include a pair of snap-fit connectors in the form of clips 175 spaced vertically apart from each other. The pair of clips 175 are insertable into the cavity 128 through the opening 130 for snap-fit engagement with respective upper and lower lips 132, 136. In the example illustrated, the clips 175 are biased to an advanced position, and are resiliently movable toward each other to a retracted position during insertion into the opening 130 and back away from each other toward the advanced position upon full insertion through the opening 130 for retaining the fastener cover 170 on the panel 104. In the example illustrated, each clip 175 has a catch surface 176 for bearing against an inner abutment surface 144 of a respective lip 132, 136 to retain the clips 175 in the fastener slot 124 (and inhibit withdrawal of the clips 175 therefrom). Upon application of sufficient force, the clips 175 are urged toward the retracted position to move the catch surfaces 176 clear of the lips 132, 136 and permit insertion and removal of the clips 175 into and out from the fastener slot 124.

In the example illustrated, the fastener cover 170 extends vertically between a lower end 178 and an upper end 180 above the lower end 178, with the snap-fit connectors 174 disposed vertically intermediate the upper and lower ends 178, 180 of the cover 170. Referring to FIG. 3, in the example illustrated, the lower end 178 is positioned vertically intermediate the fastener slot 124 and the opening 148 of the accessory slot 120. In the example illustrated, the lower end 178 is adjacent an upper periphery of the opening 148 of the accessory slot 120.

In the example illustrated, the upper end 180 is at an elevation above the upper edge 112 of the panel 104 for the cover 170 to conceal an interface 190 between the panel 104 to which the cover 170 is mounted and another panel 104 above and interconnected with the panel 104 in the slatwall arrangement.

Referring to FIG. 5, in the example illustrated, the cover body 172 of the cover 170 extends between the upper and lower ends 178, 180 for positioning of the cover 170 over the fastener slot 124 and the interface 190. The lower end 178 of the cover 170 comprises a lower flange portion 182 extending inwardly from the cover body 172 for bearing against the outer face 108 of the panel 104 to which the cover 170 is mounted. Referring to FIG. 3, the upper end 180 of the cover 170 comprises an upper flange portion 184 extending inwardly from the cover body 172 for bearing against the outer face 108 of the other panel 104 above the panel 104 to which the cover 170 is mounted. This can help retain the panels 104 flush with each other.

Referring to FIG. 2, in the example illustrated, each panel 104 is attachable to the wall structure 102 vertically between a pair of other panels 104 in the slatwall system 100. Referring to FIG. 4, in the example illustrated, the upper and lower joint profiles 116, 118 are configured to accommodate removal of each panel 104 from between the pair of other panels 104 without requiring removal of either of the other panels 104 from the wall structure 102 (e.g. to facilitate convenient replacement of a panel after installation, due to damage for example).

In the example illustrated, the upper joint profile 116 comprises a groove 150 in the upper edge 112 of the panel 104, and the lower joint profile 118 comprises a tongue 152 projecting downwardly at the lower edge 114 of the panel 104. The tongue 152 of each panel 104 is receivable in the groove 150 of another panel 104 for interconnection therebetween in the slatwall arrangement. In the example illustrated, the groove 150 is open upwardly and inwardly to the inner face 106 of the panel 104 (toward the wall structure 102 when the panel 104 is installed). The tongue 152 is in horizontal alignment with the groove 150, and is received in the groove 150 horizontally between the panel 104 and the wall structure 102. This can inhibit horizontal movement of the lower edge 114 of the panel 104 when interlocked with the upper edge 112 of another panel 104 to help retain the lower edge 114 in place. This can assist with installation of the panels 104, and help retain the panels 104 flush with each other.

In the example illustrated, the tongue 152 has an inner surface 154 directed toward the wall structure 102 and an outer surface 156 opposite the inner surface 154 and directed away from the wall structure 102. In the example illustrated, the inner surface 154 of the tongue 152 is generally coplanar with the inner face 106 of the panel 104. In the example illustrated, the outer surface 156 is recessed inwardly from the outer face 108 of the panel 104 to define a recess 158 in the lower edge 114 of the panel 104. The recess 158 is open downwardly and outwardly to the outer face 108 of the panel 104 for receiving the upper edge 112 of another panel 104.

Referring to FIG. 5, in the example illustrated, the accessory slot 120 has an undercut L-shaped profile comprising an accessory cavity 160 open to the outer face 108 of the panel 104 through a restricted accessory opening 148. The accessory opening 148 extends vertically between a floor surface 162 of the accessory cavity 160 and an upper lip 164 of the panel 104 extending downwardly along and bounding an upper portion of the accessory cavity 160. The upper lip 164 of the accessory slot 120 helps retain the organization accessory 122 when received in the accessory slot 120.

Referring to FIG. 4, in the example illustrated, each of the panel 104 and the fastener cover 170 is of integral, unitary, one-piece construction. Each of the panel 104 and the cover 170 comprises a one-piece extrusion, and has a constant cross-sectional profile along its length. In the example illustrated, the panel 104 and the fastener cover 170 are formed of the same material. Each of the panel 104 and the cover 170 can be formed of, for example, a polymeric material, such as, for example, rigid polyvinyl chloride (PVC). The panel 104 and/or cover 170 can have the natural white color of PVC, or the panel 104 and/or the cover 170 can have a different color to provide a desired aesthetic. In some examples, the panel 104 and/or cover 170 can be colored by adding PVC re-grind into the melting process to extrude the entire panel 104 and/or cover 170 in a desired color. In some examples, the panel 104 and/or cover 170 can be co-extruded using a cap-stocking process to laminate a thin layer of solid color PVC onto the white panel and/or cover profile (e.g. to add a thin colored layer on the visible outer face of the panel 104 and/or cover 170).

Figure 6:
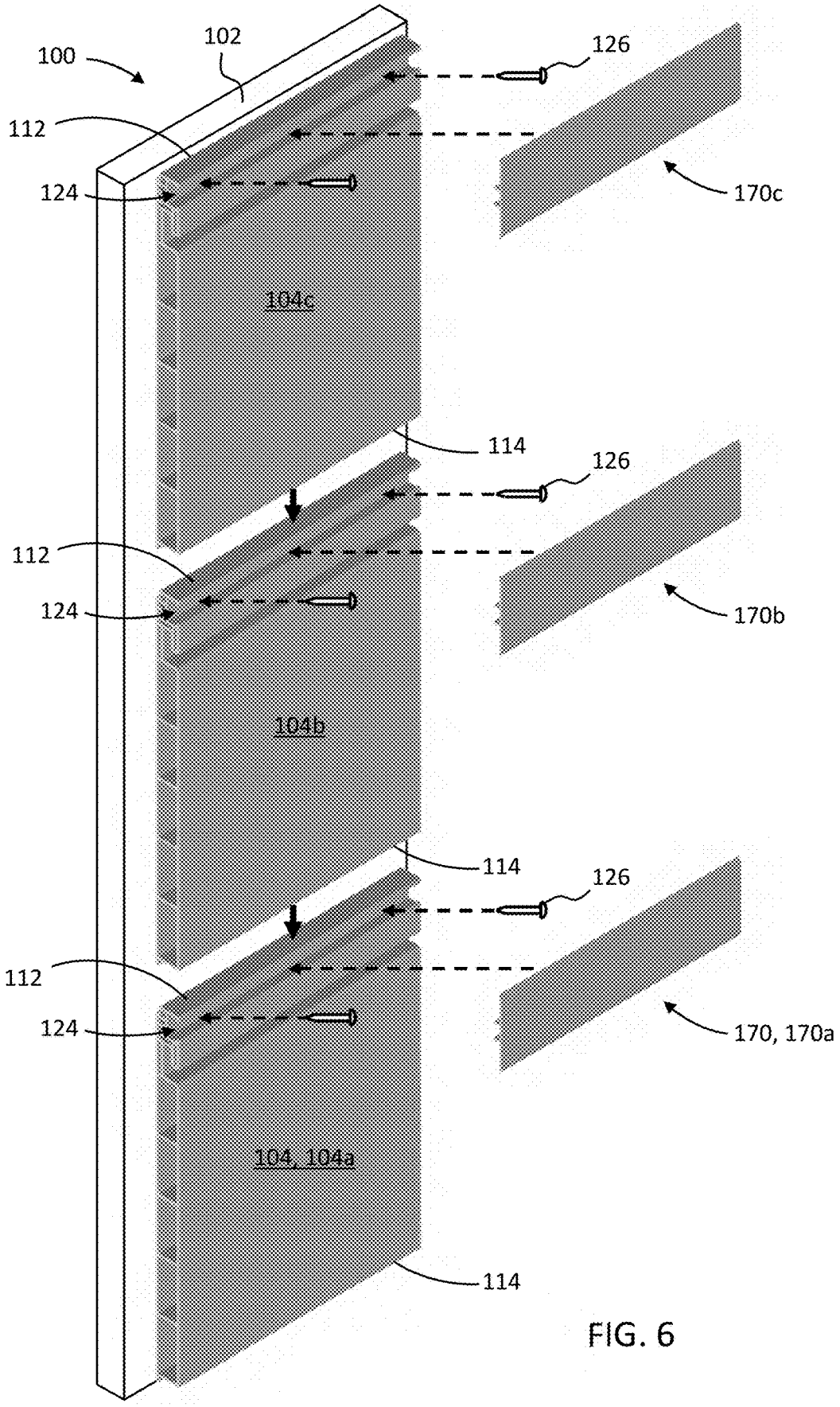
FIG. 6 is an exploded perspective view of portions of the slatwall system of FIG. 1.

Referring to FIG. 6, installation of the slatwall system 100 includes installing a first panel 104*a* on the wall structure 102 by inserting a plurality of the fasteners 126 into the fastener slot 124 of the first panel 104*a* and driving the fasteners 126 in the fastener slot 124 through the first panel 104*a* and into the wall structure 102. After the first panel 104*a* is installed, the lower edge 114 of a second panel 104*b* is interlocked with the upper edge 112 of the first panel 104*a* (e.g. by inserting the tongue 152 of the second panel 104*b* into the groove 150 of the first panel 104*a*). The second panel 104*b* is then fastened to the wall structure 102 above the first panel 104*a* and the first cover 170*a* is mounted to the fastener slot 124 of the first panel 104*a* to conceal the fastener slot 124 and an interface between the first and second panels 104*a*, 104*b*. In some examples, the first cover 170*a* is mounted after the second panel 104*b* is fastened to the wall structure 102. In some examples, the first cover 170*a* is mounted after the second panel 104*b* is interlocked with the first panel 104*a* but before the second panel 104*b* is fastened to the wall structure 102, which can help retain the second panel 104*b* against the wall structure 102 during fastening of the second panel 104*b*. The installation process can be repeated a plurality of times for installing additional panels (e.g. panel 104*c*) one above another until the wall structure 102 is covered as desired.

In some cases, one of the installed slatwall panels (e.g. panel 104*b*) may require replacement (e.g. if damaged) or removal (e.g. to access the wall structure or services behind the panel). In such cases, the second panel 104*b* can be detached from the wall structure 102 by removing the second cover 170*b* to expose the fasteners 126 securing the panel 104 to the wall structure 102, removing the fasteners 126 from the wall structure 102, and disconnecting the panel 104 from the slatwall system 100. The first cover 170*a* of the lower, first panel 104*a* may also be removed. After being unfastened, the second panel 104*b* can be disconnected by pivoting the upper edge 112 of the second panel 104*b* away from the wall structure 102 to slide the upper edge 112 outwardly from the recess 158 in the lower edge 114 of the upper, third panel 104*c*, and then lifting the lower edge 114 of the second panel 104*b* away from the upper edge 112 of the lower, first panel 104*a* (to remove the tongue 152 of the second panel 104*b* out from the groove 150 of the first panel 104*a*). The first and third panels 104*a*, 104*c* can remain fastened to the wall structure 102 during such disconnection.

Once the second panel 104*b* is removed, a replacement panel can be installed in its place, also without necessarily requiring removal and/or reinstallation of either of the other panels 104*a*, 104*b* above and below the replacement panel. Installation of the replacement panel 104 can include interlocking the lower edge 114 of the replacement panel with the upper edge 112 of the lower, first panel 104*a* (e.g. by inserting the tongue 152 of the replacement panel into the groove 150 of the first panel 104*a*). The replacement panel is then pivoted about its lower edge 114 to bring the upper edge 112 of the replacement panel 104 into engagement with the lower edge 114 of the upper, third panel 104*c* (e.g. by sliding the upper edge 112 of the replacement panel horizontally into the recess 158 of the third panel 104*c*). Once interconnected, the replacement panel is fastened to the wall structure 102 between the other panels 104*a*, 104*c* by inserting the fasteners 126 into the fastener slot 124 of the replacement panel and driving the fasteners 126 into the wall structure 102. A cover 170 can then be mounted to the fastener slot 124 of the replacement panel to conceal the fasteners 126 (and interface between the replacement panel and the third panel 104*c*), and the first cover 170*a* can be remounted back to the fastener slot 124 of the lower, first panel 104*a*.

The invention claimed is:

1. A slatwall system for installation on a wall structure, comprising:

a) at least one panel having an inner face for positioning against the wall structure and an opposite outer face spaced apart from the inner face by a panel thickness, the inner and outer faces extending lengthwise along a panel axis between opposite ends of the panel and vertically between upper and lower edges of the panel, each panel including:

i) an upper joint profile extending along the upper edge, ii) a lower joint profile extending along the lower edge, the lower joint profile of each panel interconnectable with the upper joint profile of another identical panel for interconnecting vertically adjacent panels on the wall structure in a coplanar slatwall arrangement, iii) an accessory slot in the outer face and extending along the panel axis, the accessory slot configured for mounting an organization accessory to the panel, and iv) a fastener slot in the outer face and extending along the panel axis vertically intermediate the accessory slot and the upper edge of the panel, the fastener slot for receiving fasteners to secure the panel to the wall structure; and b) at least one cover extending along the panel axis and detachably mountable to the fastener slot for concealing the fastener slot and fasteners, and the cover detachable from the fastener slot for accessing the fasteners to permit removal of the panel from the wall structure.

2. The slatwall system of claim 1, wherein the cover is mountable to the fastener slot through a snap-fit connection.

3. The slatwall system of claim 2, wherein the cover has a cover body positionable over the outer face of the panel to cover the fastener slot, and one or more snap-fit connectors projecting inwardly from the cover body and insertable into the fastener slot for snap-fit engagement between the cover and the panel.

4. The slatwall system of claim 3, wherein the fastener slot has a T-slot profile comprising a fastener cavity open to the outer face of the panel through a fastener opening, the fastener opening between an upper lip of the panel extending downwardly along and bounding an upper portion of the cavity and a lower lip of the panel extending upwardly along and bounding a lower portion of the cavity.

5. The slatwall system of claim 4, wherein the one or more snap-fit connectors include a pair of clips spaced vertically apart from each other for insertion into the cavity through the opening for snap-fit engagement with respective upper and lower lips.

6. The slatwall system of claim 1, wherein when mounted, the cover projects vertically from the panel for concealing an interface between interconnected panels.

7. The slatwall system of claim 1, wherein when mounted, the cover extends between a lower end positioned vertically intermediate the fastener slot and the accessory slot, and an upper end at an elevation above the upper edge of the panel for concealing an interface between the panel to which the cover is mounted and another panel above and interconnected with the panel in the slatwall arrangement.

8. The slatwall system of claim 7, wherein the cover has a generally planar cover body extending between the upper and lower ends and covering the fastener slot and the interface, and wherein the lower end of the cover comprises a lower flange portion extending inwardly from the cover body toward the panel for bearing against the outer face of the panel to which the clip is mounted, and the upper end of the cover comprises an upper flange portion extending inwardly from the cover body for bearing against the outer face of the other panel.

9. The slatwall system of claim 1, wherein each panel is attachable to the wall vertically between a pair of other panels in the slatwall arrangement, and wherein the upper and lower joint profiles are configured to accommodate removal of each panel from between the pair of other panels without requiring removal of either of the other panels from the wall structure.

10. The slatwall system of claim 1, wherein the upper joint profile comprises one of a tongue and a groove and the lower joint profile comprises the other one of the tongue and the groove, the tongue of each panel receivable in the groove of another panel for interconnection therebetween in the slatwall arrangement.

11. The slatwall system of claim 10, wherein the upper joint profile comprises the groove and the lower joint profile comprises the tongue.

12. The slatwall system of claim 11, wherein the groove is open to the inner face and upper edge of the panel and the tongue is in horizontal alignment with the groove.

13. The slatwall system of claim 11, wherein the tongue has an inner surface directed toward the wall structure and an outer surface opposite the inner surface and directed away from the wall structure, the outer surface recessed inwardly from the outer face of the panel to define a recess in the lower edge of the panel, the recess open downwardly and outwardly to the outer face of the panel for receiving the upper edge of a lower one of the other panels.

14. The slatwall system of claim 1, wherein each of the panel and the cover comprises a one-piece extrusion.

15. A slatwall system for installation on a wall structure, comprising:

a) a plurality of identical panels interconnectable with each other one above another in a coplanar slatwall arrangement, each panel having an accessory slot extending along a length of the panel for mounting an organization accessory to the panel, and a fastener slot spaced vertically apart from the accessory slot and extending along the length of the panel for receiving fasteners to secure the panel to the wall structure; and b) a plurality of identical covers, each cover extending along the length of the panel and detachably mountable to a respective fastener slot for concealing the fastener slot and fasteners, and each cover detachable from the fastener slot for accessing the fasteners to permit removal of a respective panel from the wall structure, and wherein when mounted, each cover projects vertically from a respective panel for concealing an interface between interconnected panels.

16. The slatwall system of claim 15, wherein each cover is mountable through snap-fit engagement with the fastener slot.

17. The slatwall system of claim 15, wherein each panel has an upper edge, a lower edge vertically opposite the upper edge, one of a tongue and a groove extending along the upper edge, and the other one of the tongue and the groove extending along the lower edge, and wherein the tongue of each panel is receivable in the groove of another panel for interconnection therebetween in the slatwall arrangement.

18. The slatwall system of claim 17, wherein the upper edge of each panel comprises the groove and the lower edge of each panel comprises the tongue, the tongue recessed inwardly from an outer face of the panel directed away from the wall structure to define a recess in the lower edge of the panel, the recess open downwardly and to the outer face of the panel for receiving the upper edge of another panel when the panels are installed on the wall structure.

* * * * *